US009394677B2

(12) United States Patent
Albers et al.

(10) Patent No.: US 9,394,677 B2
(45) Date of Patent: Jul. 19, 2016

(54) SYSTEMS AND METHODS FOR STORAGE AND TREATMENT OF REMEDIATION MATERIALS

(71) Applicants: Cory Albers, Calgary (CA); Bernard Amell, Calgary (CA)

(72) Inventors: Cory Albers, Calgary (CA); Bernard Amell, Calgary (CA)

( * ) Notice: Subject to any disclaimer, the term of this patent is extended or adjusted under 35 U.S.C. 154(b) by 50 days.

(21) Appl. No.: 14/307,603

(22) Filed: Jun. 18, 2014

(65) Prior Publication Data

US 2014/0369762 A1 Dec. 18, 2014

Related U.S. Application Data

(60) Provisional application No. 61/836,365, filed on Jun. 18, 2013.

(51) Int. Cl.
*E03F 11/00* (2006.01)
*E03F 5/10* (2006.01)

(52) U.S. Cl.
CPC ..... *E03F 5/103* (2013.01)

(58) Field of Classification Search
CPC ..... E03F 5/103; E03F 5/10
See application file for complete search history.

(56) References Cited

U.S. PATENT DOCUMENTS 4,298,471 A * 11/1981 Dunkers ..... E03F 5/101 210/242.1
4,672,691 A * 6/1987 De Garie ..... B09B 1/00 210/218
4,911,831 A 3/1990 Davison et al.
5,311,682 A 5/1994 Sturdivant
5,355,594 A * 10/1994 Hwang ..... F26B 1/00 34/356
6,119,375 A * 9/2000 Wilson, Sr. ..... B09B 1/00 37/195
6,835,314 B2 * 12/2004 Keller ..... B01D 29/27 210/710
8,333,895 B2 12/2012 Albers et al.
2009/0148238 A1 * 6/2009 Smith ..... B09B 1/00 405/129.2

FOREIGN PATENT DOCUMENTS

WO 2012027620 3/2012

* cited by examiner

*Primary Examiner* — Benjamin Fiorello
(74) *Attorney, Agent, or Firm* — Parlee McLaws LLP (CGY); Linda M Thompson

(57) ABSTRACT

Remediation materials are stored and treated within remediation cells constructed within a pond. The remediation materials originate from a variety of sources including the pond in which the remediation cells are constructed. The volume of the remediation cells is relatively small compared to the total volume of the pond and thus, the total active volume of the pond to handle stormwater flood events is not significantly diminished. Remediation of the remediation materials in the cells is accomplished through a variety of processes, including dewatering and/or by bioremediation therein. The water level in the remediation cells during normal operation outside flood events is maintained at levels which support the remediation processes. When the remediation cells are filled over time, remediated material can be removed for use in constructing other remediation cells, wetlands or marshes in the same or other ponds or can be located to areas remote from the pond.

41 Claims, 6 Drawing Sheets

SYSTEMS AND METHODS FOR STORAGE AND TREATMENT OF REMEDIATION MATERIALS

CROSS-REFERENCE TO RELATED APPLICATIONS

This application claims the benefits, under 35 U.S.C. 119 (e), of U.S. Provisional Application 61/836,365, filed Jun. 18, 2013, the subject matter of which is incorporated herein by reference in its entirety.

FIELD

Embodiments disclosed herein relate to methods and systems for storage and treatment of remediation materials such as those removed from bodies of water and, more particularly, to methods and systems of storage and treatment within the same or another body of water.

BACKGROUND

It is well known, in storm water and industrial liquid waste management systems, to provide ponds to receive contaminated water flows for treatment prior to discharging the treated water into local watersheds or sewers, where permitted. Treatment typically entails a first step of enabling fluid residence within the pond to allow for a time dependent, water quality improvement process to take place, such as sedimentation of suspended matter, including but not limited to silt, sand and clay. The initial residence step may include additional treatment or the additional treatment may be included in one or more subsequent steps, such as secondary and tertiary steps, to encourage composting, nutrient removal and the like for further clarifying the treated water.

In urban areas, municipal water ponds typically form a water feature about which residences may be located. Many of these constructed water bodies, particularly those in municipal settings, are of a size and configuration such that most of the pond surface area is within a fixed distance, for example about 50 m, of the pond's edge. Other ponds, such as industrial ponds or tailings ponds used in mining or oilsands processing or a variety of other industrial processes, are typically similarly sized. Further, the constructed water bodies may have components associated therewith from which much of the surface area of the pond is within the fixed distance. Over time, solid materials such as sediment may build up in these ponds, reducing the pond's utility. Applicant believes that the sediment which accumulates in these ponds tends to be of a uniform, slurry consistency. Accumulations of the sediment eventually reduce the ponds effectiveness.

A conventional remedy to pond sediment accumulation includes draining the pond in order to provide access for excavating machines and conveyance vehicles to remove and dispose of the sediment. One complication to such excavation processes is the close proximity of the residences, construction sites, landscaped terrains with trees or other valuable vegetation or other features which may surround the perimeter of the pond and restrict access thereto by the excavation equipment and sediment disposal carriers.

In municipal environments, remediation processes are often scheduled during the winter. The pond may be drained into the municipal sewer system if drainage onto natural water ways is not permitted during the winter months.

A plurality of backhoes is often employed in a chain arrangement to shovel sediment from a point in the pond to a point closer to the shore and from there to a point on shore for loading onto trucks. The process can, for example, take from 1 to 2 months for remediation of a typical storm water pond. Current cost estimated in Calgary, Alberta, Canada is about $3M for removal of sediment from each pond. Sediment removal is performed for each pond once every 10 to 20 years or so. Furthermore, Applicant believes that a current cost of disposing of the removed sediment is about $2M for each pond, particularly if special disposal procedures are required, such as for contaminated material landfill disposal as may be required for some stormwater or industrial water ponds. Thus, with a projected cost of about $5 million to remediate each stormpond, municipal governments are faced with significant budgeting issues. Given that large cities may have large numbers of stormponds and each stormpond will require remediation about every 10 to 20 years, the costs are significant.

The conventional remediation process, as described, is laborious, requires a long time to complete and is very expensive. Disposal of the drained water may be impractical due to government regulations and permits. Conventional pond remediation also tends to be disruptive to the peace and enjoyment of the local residents. Disposal of removed remediation materials, such as the sediment slurry, is expensive and impractical. Disposal typically involves a process of spreading slurry on other lands to allow the slurry to dry or thickening of the slurry using specialized dewatering equipment.

Shoreline and barge-mounted dredging has been exploited to remove materials from the bottom of water bodies as taught in U.S. Pat. No. 4,942,682 to McDowell. McDowell utilizes a self-contained, reversible dredging module adapted for use as an attachment to a conventional backhoe machine, thereby creating a two-segment backhoe. Applicant believes that access to the pond surface using such a two-segment backhoe is limited, such as to about 15 m from the shore.

As the surface of municipal ponds, industrial ponds or tailings ponds used in mining, oilsands and a variety of other industrial processes have a surface area typically extending much further than 15 m from the shore, a major portion of the pond surface is out of reach of the apparatus as taught in McDowell, unless the pond is almost completely dewatered or the apparatus is supported by a floating barge. Use of a floating barge sufficient in size to accommodate the apparatus of McDowell may be impractical, particularly for use in ponds where access is restricted such as in urban settings in close proximity to residences, construction sites, landscaped terrains and other types of access restrictions. McDowell does not disclose any sophisticated systems which might permit programming remediation patterns or monitoring the location of such apparatus relative to the pond surface and perimeter.

U.S. Pat. No. 4,911,831 to Davison et al teaches a self-propelled, floating apparatus and land-based crane gantry for skimming sand from beds of slow sand filters. An auger skimmer removes sand to a pre-determined depth and conveys the sand to a pump for delivery to a remote location via a floating conduit. The pump is located mid-point along the intake conduit away from the point of intake of the sand/water slurry. The slurry has a preferred density of 20% w/w sand. Augur depth is tracked and controlled however azimuthal location is not. Sonar, laser, audio and camera sensors are employed to set and monitor dredging depth. The apparatus of Davison et al is specifically designed for sand filter beds used in water purification plants and requires that weeds be removed from each filter prior to utilizing the sand skimmer. Cutters for removing weeds prior to suctioning the sand may be incorporated.

A floating, mechanical clamshell and hydraulic dredge is disclosed in U.S. Pat. No. 5,311,682 to Sturdivant. The dredge apparatus is fit with angular and linear displacement sensors to permit geo-location for data logging and quality assurance of work completed. Sturdivant is not shoreline based and must navigate the pond to each site requiring remediation. Sediment is removed at near in situ water content, as re-suspension due to water disturbance is minimized. High density sediment is removed and conveyed at low speed and may require pre-pump particle size reduction. A pipeline speed of 1 to 2 m/s compared to the prior art speeds of 2 to 5 m/s for a slurry density of 0% to 30% are quoted. Dredging operations may be tracked and optimized by electronically linking sensors on the apparatus to a data processor such as a PC or a PLC. Sensors on the apparatus may include GPS sensors.

An oil skimmer for use in remediation of oil spills is disclosed in published PCT application WO 2012/027620 to Brown et al. A platform or vehicle having an extendable arm is fit with a fluid skimmer for removing contaminants, particularly oil, which are at or near the surface of contaminated bodies of water such as rivers, lakes, marshes and the like. A pump on the skimmer collects contaminants from the water surface and delivers same to a collection reservoir, via a conduit. Alternatively, instead of a pump, a land-based service apparatus embodiment utilizes a boom connected directly to a vacuum truck for sucking water and contaminants from the surface of the water.

Systems and methods for improving water quality in ponds is described in Applicant's issued U.S. Pat. No. 8,333,895, incorporated herein by reference in it's entirety, with respect to Applicant's NAUTILUS POND®. The described systems focus on enhancing sediment and/or nutrient removal performance which are generally considered important functioning components of a pond system. Typically, removal of sediment accumulations from such ponds would require taking an entire pond offline for the duration of a sediment removal operation.

Land-based pond remediation, as disclosed in the prior art, appears to be limited largely by the reach of the equipment used, characteristics of the sediment slurry or other remediation material targeted for removal and pond operation. These limitations are exacerbated in developed areas due to additional constraints imposed by architectural features, landscaping and legislative considerations. Whereas these limitations may be overcome to some extent with the use of an improvised assortment of currently available equipment or a floating apparatus, the equipment is complex and adds constraints of transportation, provision of access to pond and adapted waste conveyance structures.

A remediation process, land-based or otherwise, is further complicated by the fact that prior art techniques require removal and disposal of sediment slurry to an offsite location. Transportation of the removed sediment slurry is inefficient as a large, majority fraction of the slurry volume, removed using prior art equipment is composed of water rather than solids. Use of specialized slurry thickening equipment may assist in reducing the water content and transportation costs, however the cost of each additional piece of equipment adds to the overall remediation operation cost, the complexity of the operations and the risk of equipment failure resulting in lengthy completion delays.

Clearly, there is interest in cost-effective, efficient, environmentally safe systems and methods for handling and storage of materials removed from water bodies such as ponds.

SUMMARY

Remediation cells are formed within the perimeter of a recipient pond for receipt of remediation materials, such as sediment and slurry, which are deposited therein. Remediation processes, such as dewatering and bioremediation, occur within the remediation cells and the environment of the remediation cells are designed to support such processes. Thus, a portion of the pond volume which is not normally in use, except for during stormwater flood events, can be utilized for the remediation of the materials. Costs associated with conventional transport of remediation materials to locations remote from the pond are avoided. Further, costs associated with conventional remediation of said materials prior to land spreading disposal are also avoided.

In one broad aspect, a system for storage and treatment of remediation materials comprises a recipient pond having a pond perimeter and containment elements positioned within the pond perimeter for forming one or more remediation cells. The remediation cells receive the remediation materials therein and are fluidly connected to the recipient pond for receiving water therein when the water level in the recipient pond is above a normal water level for participating in active storage of water in the pond. The remediation cells are at least semi-isolated when the water level is at the normal water level for permitting some water exchange with the recipient pond at a rate of influx which minimizes energy imparted thereto for minimizing disruption of remediation processes therein.

In a broad method aspect for storage and treatment of remediation materials, containment elements are positioned in a recipient pond for forming one or more remediation cells within a perimeter of the recipient pond. The one or more remediation cells are fluidly connected to the recipient pond for receiving water therein when the water level in the recipient pond is above a normal water level for participating in active storage of water in the pond and at least semi-isolated when the water level is at the normal water level for permitting some water exchange with the recipient pond at a rate of influx which minimizes energy imparted thereto for minimizing disruption of remediation processes therein. The remediation materials from at least one remediation operation are deposited to at least one of the one or more remediation cells in the recipient pond.

The remediation materials can be materials removed from the recipient pond or can be from another source. Materials from more than one remediation operation can be deposited to the same remediation cell in the same pond. Once remediated, the materials can be removed from the one or more remediation cells and can be used to construct containment elements for forming remediation cells in the same or another recipient pond or can be used for forming wetlands or marshes in the same or another pond. Remediated materials can also be removed and located remote from the pond as in conventional operations.

DETAILED DESCRIPTION

Embodiments disclosed herein provide methods and systems for handling remediation materials such as those removed from bodies of water. The water bodies can include constructed water bodies, such as stormwater ponds commonly referred to as stormponds, and natural water bodies.

The embodiments are discussed herein in the context of ponds generally or stormponds in particular, however, as one of skill will appreciate, embodiments taught herein are applicable to a variety of constructed and natural water bodies, including, but not limited to, stormponds, industrial process water ponds or tailings ponds such as are used in mining, oilsands and a variety of other industrial processes and the like, rivers, lakes, wetlands and other natural water bodies. The terms "remediation materials", "sediment" and "slurry" are generally used interchangeably herein. Further, the terms "consolidation", "thickening" and "dewatering" are also generally used interchangeably herein.

Remediation materials to be handled according to embodiments taught herein can result from removal from ponds using any suitable remediation apparatus, such as prior art dredging or excavation apparatus and extended-reach, pump-enabled apparatus such as taught in Applicant's co-pending US application, U.S. Ser. No. 14/277,523 filed May 14, 2014 which claims the benefit of U.S. 61/822,998 filed May 14, 2013. The remediation materials can be pumpable or can be materials which are not readily pumpable.

In direct contradistinction to prior art methods which handle remediation materials removed from ponds by transport from the pond location for dewatering, decontamination where required and finally spreading on land, embodiments taught herein store or utilize the removed materials within a recipient pond, which can be the same pond from which the remediation materials are removed or another pond. Thus, viable, relatively low impact and low cost remediation is possible which can be used over extended periods of time, for decades and perhaps greater than 100 years, for one or more remediation operations, before alternate remediation processes need be considered.

Embodiments utilize pond area in the recipient pond which may not be significantly contributing to the process of removing sediment from inflowing stormwater. The recipient pond is structured to have one or more relatively small, isolated or semi-isolated remediation cells formed therein which are designed for ease of maintenance and to support the execution of pond remediation operations.

Figure 1:
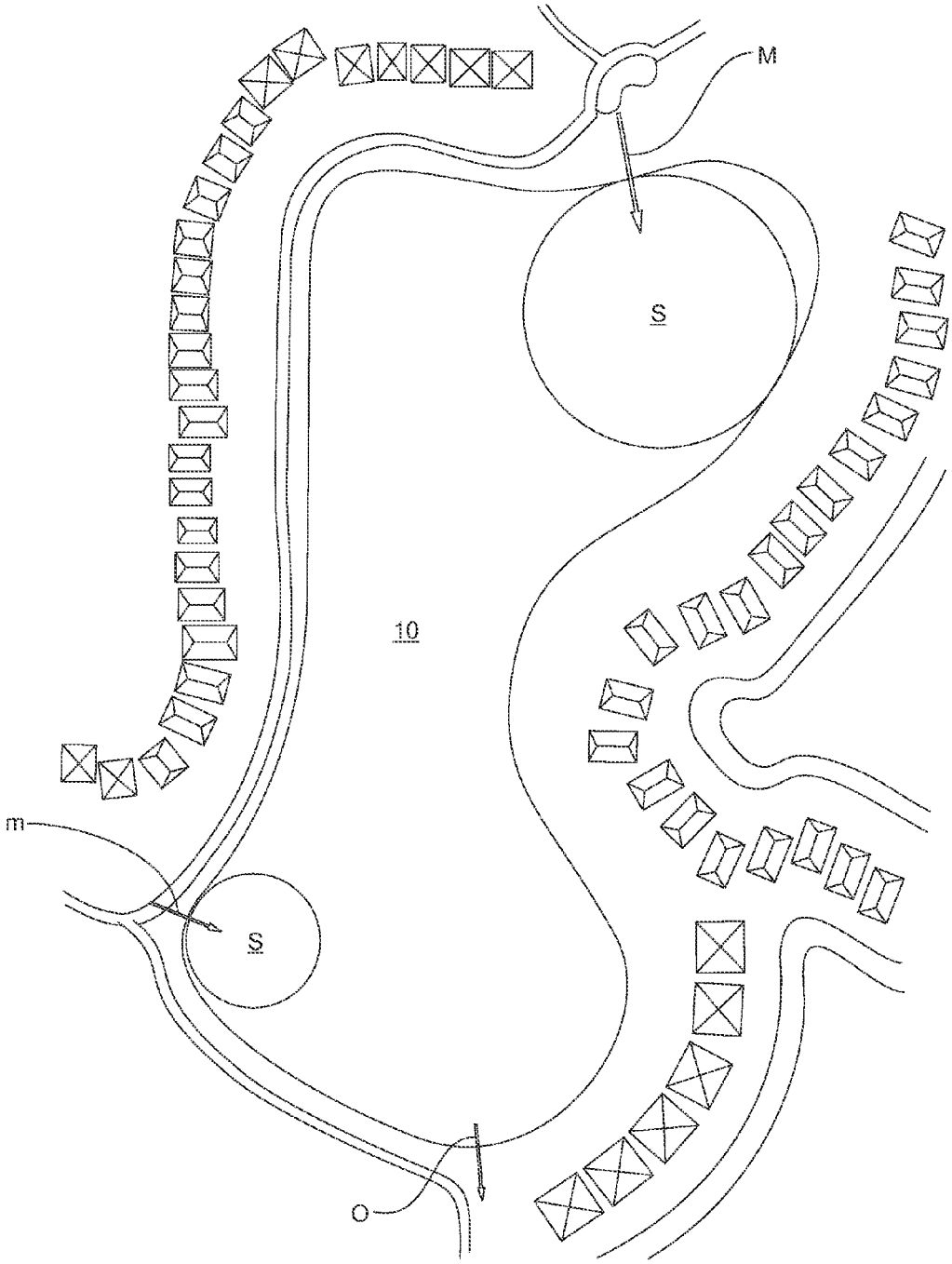
Fig. 1 PRIOR ART
FIG. 1 is a plan view of a prior art stormpond illustrating typical sedimentation areas adjacent inlet locations.

Having reference to FIG. 1, a simple prior art stormpond 10 has major and minor inflow or inlet areas M,m and at least one outflow area O downstream thereof. Sediment deposits S typically form near each major and minor inlet location M,m. The deposition shape of the sediment S at the inlet areas M,m is unlikely to be circular, as depicted, but rather will tend to develop relatively localized sediment deposition zones S relatively close to the inlets M,m as well as typically light and very distributed sediment deposition patterns (not shown) in the remainder of the pond 10. Only a small, minority fraction of a permanent water volume, that is to say the water volume below a normal water level, and/or a footprint area of the prior art stormpond 10, is typically responsible for removing a majority fraction of sediment S from inflowing stormwater. As a result, much of the remaining footprint in an existing stormpond 10 is available to be reconfigured for other purposes in support of ongoing remediation processes involving the long term strategic management and disposal of the remediation materials or sediment S.

Figure 2:
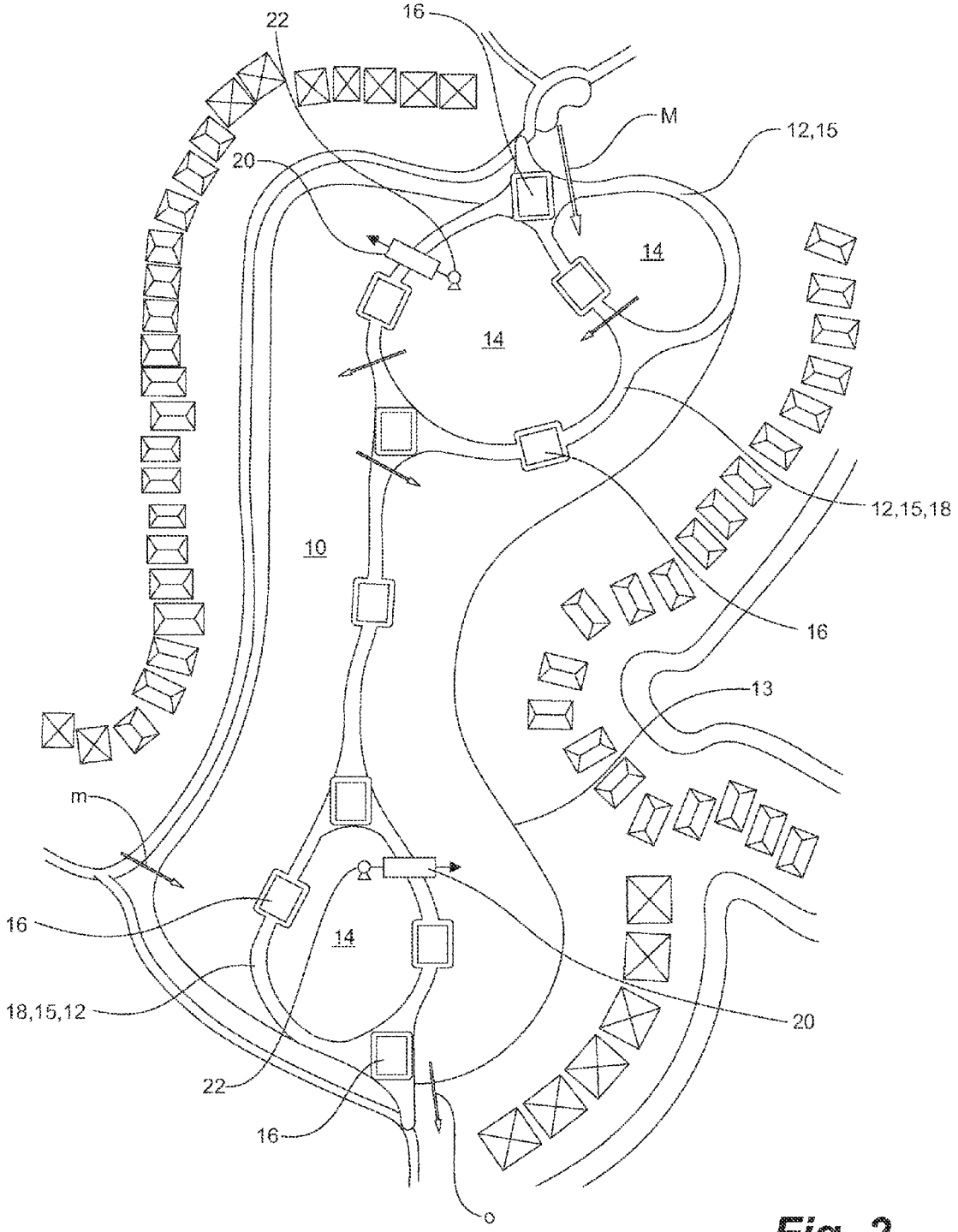
FIG. 2 is a plan view of a stormpond according to an embodiment described herein having a network of containment elements, typically equipment platforms and access causeways forming one or more remediation cells within a perimeter of the storm pond.

Having reference to FIG. 2, containment elements 12 are positioned within a perimeter 13 of a recipient pond 10 for forming the one or more, remediation cells 14 within the pond 10. The remediation cells 14 generally influence a small active water volume, compared to the larger total volume of the recipient pond 10, so as to avoid significant reduction in the total active water storage capacity of the pond 10, enabling the pond 10 to continue its primary function during stormwater events. In embodiments, remediation cells 14 influence an active water volume in the pond 10 of about 10% or less of the total active water storage capacity and thus only reduce the active storage volume of the entire stormpond 10 by about 10% or less.

In embodiments, the containment elements 12, which can be submerged, unsubmerged or semi-submerged, are earthen berms, formed within the pond 10 to form a cell perimeter 15 about the one or more cells 14.

In embodiments, alternatively or temporarily, the containment elements 12 are formed by floating curtain-like materials defined to confine remediation materials S or the like to a general footprint for forming the containment element 12 within, whereupon known sediment consolidation processes are used to consolidate the materials for forming the containment elements 12. Alternatively or in a latter phase of formation as described above, the containment elements 12 can include vegetation growing thereon.

In yet other embodiments, the containment elements 12, with or without vegetation are temporary or permanent fabric barriers, other rigid or flexible wall elements which may or may not incorporate floatation elements, similar functional elements or some combination thereof.

The remediation cells 14 are generally fluidly isolated from the recipient pond 10 when the recipient pond 10 is at a normal water level in embodiments where the containment elements 12 have an elevation which extends above the recipient pond's normal water levels. When isolated, energy typically resulting from a rate of flow of water over time to the remediation cell 14, is avoided so as to prevent disruption of remediation processes occurring in the remediation cell 14. Alternatively, the remediation cells are semi-isolated, wherein the containment elements 12 permit some exchange of water with the recipient pond 10, but at a rate of flow into and out of the remediation cell 14 which minimizes transfer of sufficient energy to the pond 10 to disrupt the remediation processes therein. Semi-isolation can also be achieved through configuration of the recipient pond 10 and the one or more remediation cells 14 therein to direct flow energy delivered to the recipient pond 10 through the major and minor inlets M,m away from the one or more remediation cells 14.

In either case, isolated or semi-isolated, the remediation cells 14 are available to receive water from an inflowing stormwater flood event of only modest size, which can be expected to raise the water level in the recipient pond 10 to the level where water overtops the containment elements 12 around the one or more remediation cells 14 resulting in flooding of the remediation cells 14. Thus, the remediation cells 14 do not diminish the recipient ponds main objective of providing sufficient active water storage volume to handle such stormwater flood events.

For example, if the containment elements 12 enclosing a remediation cell 14 have a maximum elevation of about 0.5 m above the pond's normal water level, the remediation cell 14 will be functionally and fluidly isolated from the recipient pond 10 until the recipient pond's water surface level rises by more than 0.5 m above the normal water level. Ponds 10 typically operate, a majority of the time, with the water level at or near the normal water level and thus, an isolated or semi-isolated remediation cell 14 will be functionally isolated from the recipient pond 10 the majority of the time.

Having reference again to FIGS. 2 and 3, in an embodiment, the containment elements 12 are berms which include equipment platforms 16 for supporting remediation apparatus thereon and may also support recreational equipment, such as picnic tables and the like. The platforms 16 are typically interconnected by a network of causeways 18 which act as the containment elements 12 for forming at least the one or more remediation cells 14 therein. Each causeway 18 may be used to enable vehicular and/or public access as well as to provide the localized remediation cell containment or other desired functions. Causeways 18 may also serve aesthetic or functional purposes in the context of providing a physical element that can be used to grow and develop aquatic and/or riparian ecosystems supporting plant communities. A peninsula may be formed where a causeway 18 connects an equipment platform 16 to the perimeter P.

Figure 3:
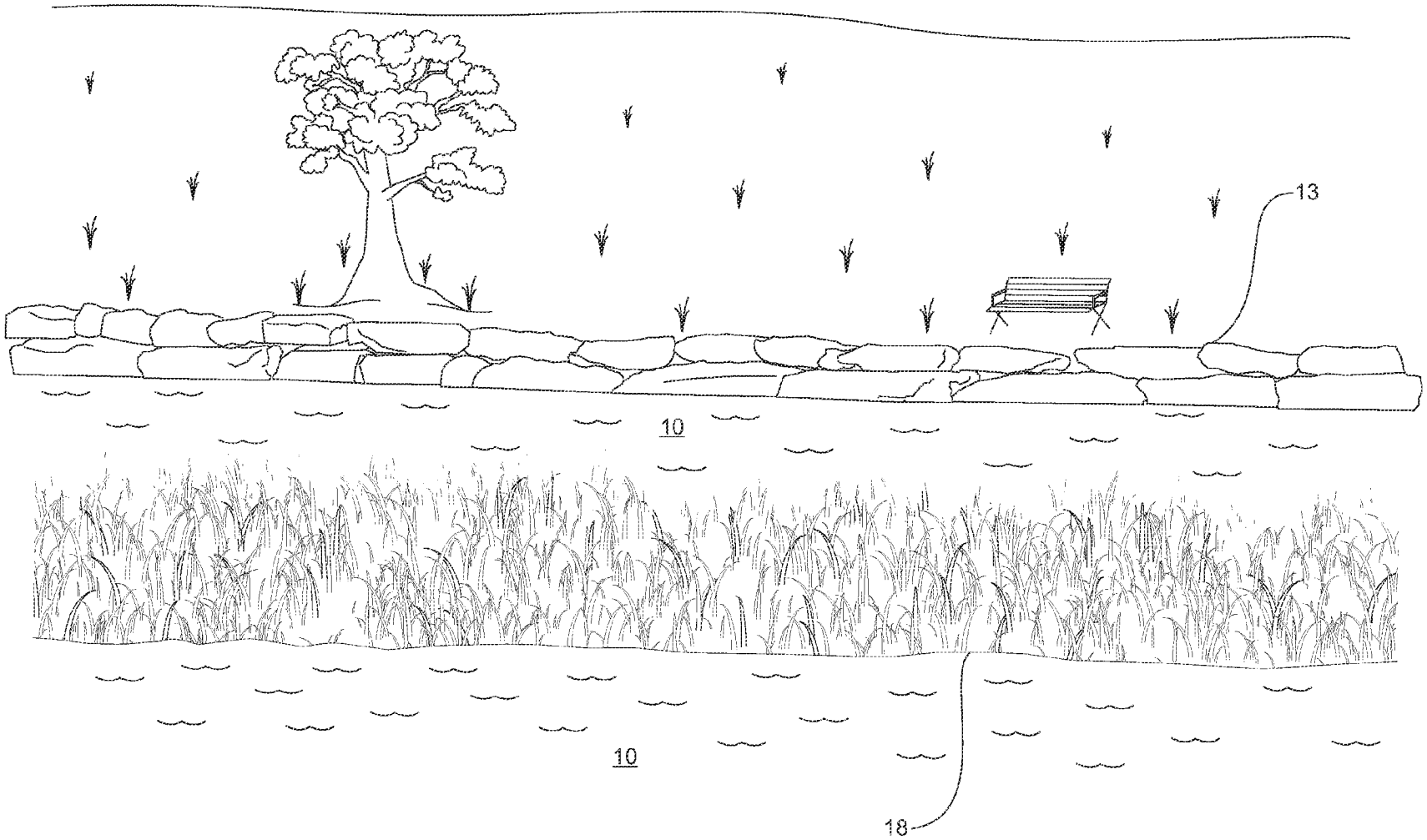
FIG. 3 is a representative illustration of a portion of the causeway of FIG. 2, formed in a pond and viewed from the perimeter and illustrating populations of plant growth thereon.

FIG. 3 illustrates how causeways 18 may appear to an observer on the perimeter 13, looking across the recipient pond 10. It is desirable to construct causeways 18 and equipment platforms 16 so that these structures are only slightly above the normal water level of the stormpond 10. Thus, as previously described, a relatively modest inflow storm flood event may cause partial or total flooding of these structures. The ability to partially or totally flood these structures, and the remediation cells 14 therein, avoids any significant reduction in available active or live water storage, which is the available water storage volume above the pond normal water level. Therefore, the pond 10 is still able to meet the most basic function of a stormpond 10 which is to provide temporary water storage of stormwater inflow events.

As one of skill in the art will appreciate, FIGS. 2 and 3 are illustrative of an example of schematic, minimal extent and geometric arrangements of causeways 18, peninsulas and equipment platforms 16. A variety of designs, configurations, aesthetics and biological diversity are possible without departing from the inventive concepts taught herein.

In embodiments and as noted above, where existing stormponds are reconfigured according to embodiments taught herein, the causeways 18 and equipment platforms 16 are constructed in a manner that would reduce the active storage volume of the entire stormpond 10 by only a relatively small amount, such about 10% or less. Where it is desirable to construct embodiments taught herein in a prior art pond 10 which contains localized accumulations of remediation materials S, a staged construction plan can be devised to construct containment elements 12 for creating a first remediation cell 14 using the accumulated remediation materials S. Thus, a portion of the pond 10 is cleared to permit construction of further containment elements 12 and remediation cells 14 therein.

Remediation cells 14 generally provide storage of remediation materials S therein however the materials S are also remediated therein through processes such as settling, dewatering, thickening or consolidation, bioremediation and the like. While settling is likely to occur initially upon deposition of the materials S into the remediation cells 14, the other processes may occur over time, either sequentially or concurrently.

The process of slurry thickening within the one or more remediation cells 14 may be functionally accelerated through mechanical agitation, vibration and/or through the addition of chemically or biologically active water conditioning agents, as is understood by those of skill in water and wastewater treatment system design and operation. Further, the one or more remediation cells 14 may be configured according to one or more embodiments disclosed in Applicant's issued U.S. Pat. No. 8,333,895, such as having a peripheral inlet and a central discharge, to enable efficient and effective recirculation and addition of water conditioning agents.

In use, each remediation cell 14 receives one or more volumes of remediation materials S which are deposited and contained within each remediation cell 14 over an extended period of time in the isolated or semi-isolated environment. Unlike prior art techniques, where transport of remediation materials S having a high water content to offsite locations for disposal is very expensive and inefficient, remediation cells 14 taught herein are well suited to receive relocated remediation materials S having low or high water content. Remediation materials S may comprise inorganic sediment or other inorganic materials, organic materials that accumulate over time with the inorganic materials, organic materials from offsite sources or from sources within the pond 10, such as aquatic weeds or other plants or any combination thereof. The remediation cells 14 typically have a footprint size which enables the separation of remediation materials S from carrier fluid, typically water, at relatively high inflow rates.

By way of example, a generally round remediation cell 14, having a diameter of about 100 m is capable of continuously receiving high or low water content relocated remediation material S at flow rates that may exceed 1000 L/s. The remediation cell 14, at the high inflow rate, is still capable of effectively separating fine particulate remediation materials S, such as silt, from the carrier fluid, with only the finest clay material and generally neutrally buoyant materials bypassing the remediation cell 14 to flow into the pond 10.

In embodiments, containment elements 12 can be further designed to comprise, in whole or in part, fabric-like materials, vegetation, porous berms or the like which are capable of retaining at least a portion of the finest clay material and generally neutrally buoyant materials within the remediation cell 14. By eliminating the need to select equipment and techniques capable of maintaining relatively low water content, there are greater opportunities for reducing the cost of a remediation operation when compared to prior art techniques.

Thickening of remediation materials S within the remediation cells 14 generally occurs over time. Time available for thickening can range anywhere from minutes to years depending on factors such as the ratio of a volume of the remediation cell 14 relative to a total volume of remediation materials S generated in a particular remediation operation.

As one of skill will appreciate, depending upon the remediation processes occurring within the one or more remediation cells 14, a normal water level in any one of the cells 14 may be full, which Applicant understands to be at or above the containment elements 12, or may be dry, which Applicant understands to continue to provide subsurface moisture sufficient to support target vegetation therein. Understandably, depending upon the processes therein, the normal water levels can be somewhere between full and dry. Similarly, the normal water level in a single remediation cell 14 can vary depending upon the topography within the cell 14.

Having reference again to FIG. 2, in embodiments, a water level in each remediation cells 14 may be controlled through a hydraulic control element 20, including, but not limited to, gates, valves, weirs, pipes, pumps or the like and combinations thereof.

In embodiments, the hydraulic control elements 20 serve as a means of hydraulic conveyance or are fluidly connected to the means of hydraulic conveyance 22, directed to moving water from a desirable location and/or elevation within the remediation cell 14 from which the water may be expected to move from within the remediation cell 14 to the recipient pond 10. Such hydraulic conveyance means 22 include, but are not limited to pipes, channels, swales, spillways or the like. Further, water level control may simply occur through spilling over the top of the containment element 12 into the recipient pond 10 such as when remediation materials S are deposited into the remediation cell 14. One of skill will also understand that during periods of drought, water may be added into the remediation cell 14, such as by pumps drawing from the recipient pond 10 or from offsite transport of water to the pond 10, to maintain the water level in the remediation cell 14 within a designed or normal operating range to support the remediation processes therein, including but not limited to supporting growth and maintenance of a target plant community.

Despite relatively modest stormwater flood events overtopping the containment elements 12, Applicant believes that known methods and systems, such as silt fences or the like, may be incorporated into the containment elements to mitigate against the disturbance of the remediation materials S and processes ongoing within each remediation cell 14. Alternatively, communities of vegetation may be established in and around a remediation cell 14 in a manner that will functionally mitigate against disturbance and potential mobilization of remediation materials S in the event a remediation cell 14 is flooded.

Since the remediation cell 14 is small relative to the entire stormpond 10 footprint, it may be dewatered or managed, such as after a stormwater flood has passed, much more conveniently than if such an isolated or semi-isolated environment were not available. In embodiments, remediation cells 14 may be dewatered for thickening of sediment S therein using a hydraulic control element 20, such as a permanent, semi-permanent or portable pump 22, to maintain the cell's normal water level below the normal water level in the recipient pond 10. Where the cell's water level is reduced as described, an active water storage volume in the remediation cell 14 is increased and may offset active water storage reductions in the recipient pond 10 from the construction of equipment platforms 16 and causeways 18 therein.

Figure 4:
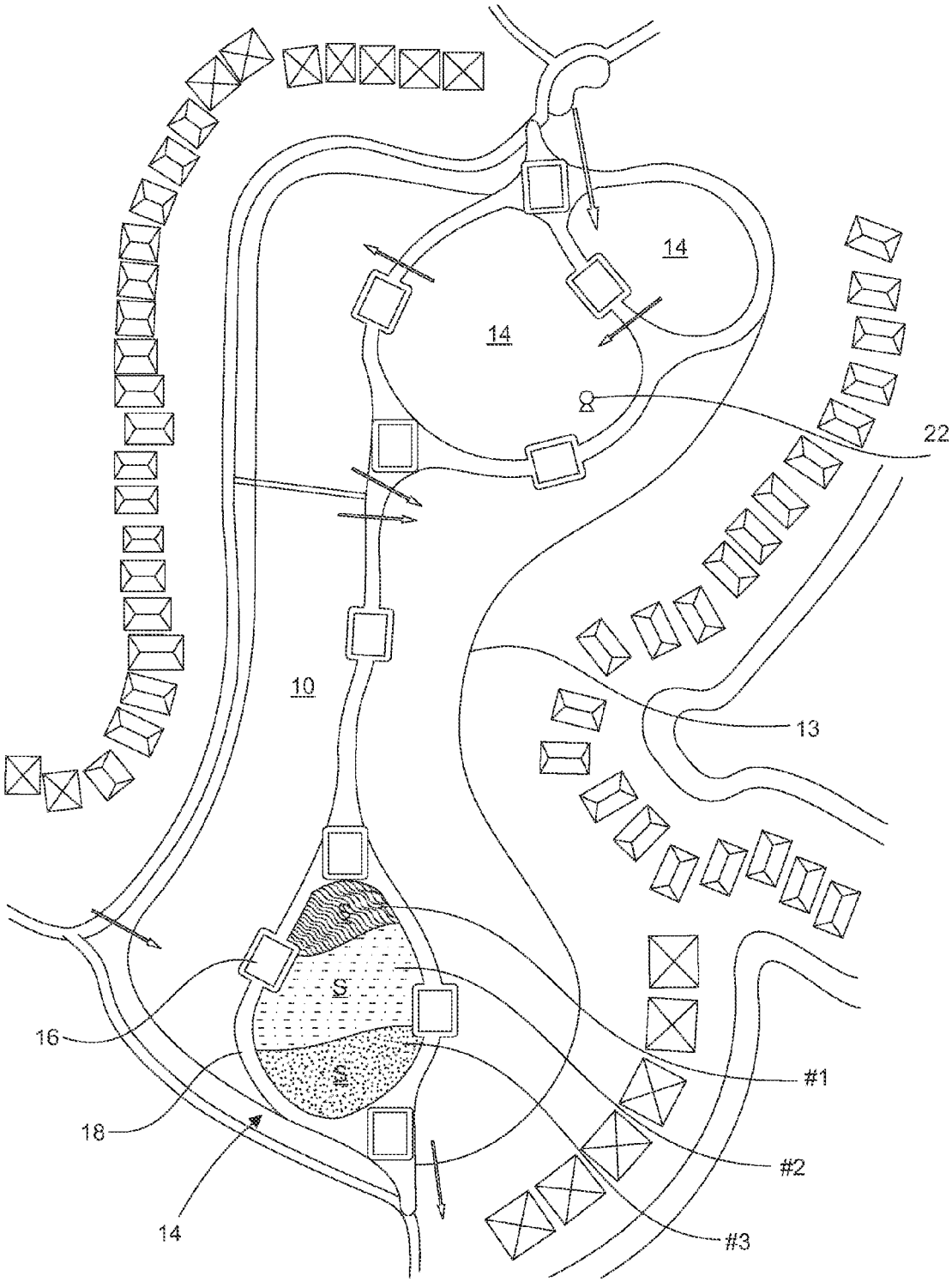
FIG. 4 is a plan view according to FIG. 2, illustrating use of one of the remediation cells for receiving slurry materials from the same pond or a different pond over an extended period of time, shown in this case receiving slurry from three separate remediation operations.

Having reference to FIG. 4, a remediation cell 14 may be used to store remediation materials S over the course of a plurality of remediation operations within the recipient pond 10 or from a plurality of remediation operations occurring elsewhere. In FIG. 4, three separate depositions of remediation materials S are shown by way of example. A first deposition #1 results in the filling of only a portion of the capacity of the remediation cell 14 allowing for subsequent depositions #2, #3 to be executed until the remediation cell 14 has reached the design capacity.

Alternatively, one or more remediation cells 14 may be configured with the intention of executing a single relocation of remediation materials S therein, only at such time as there is sufficient accumulated remediation materials S to reach design capacity of the remediation cell 14.

Regardless the number of depositions of remediation materials S required to fill the remediation cell 14, each remediation cell 14 may be used simply for remediation material storage or alternatively, may be used to create beneficial wetlands, marshes or other biologically focused systems that could serve to remove nutrients and/or fine sediments from inflowing stormwater or beneficially create habitats and/or increase biological diversity.

In embodiments, as previously noted, a remediation cell 14 may be dewatered below the normal water level in the recipient pond 10 using the permanent, semi-permanent or portable pumps 22. Dewatering in this manner may encourage simple, yet time consuming, consolidation dewatering of slurry materials S or may enable the use of plant communities as a means by which water is removed from a slurry S, thus thickening the slurry S over an extended period of time. As growth and development of many plant species requires specific depths of water to occur, dewatering of the remediation cell 14 below the normal water level of the recipient pond 10 may be necessary to encourage the establishment of such desirable plant communities, particularly given varying bottom shapes within the remediation cells 14. As can be appreciated, the bottom shape may vary at any given time, such as in response to the execution of one or more sediment removal operations from within the cells 14. The water depth for target plants may vary spatially within a remediation cell 14 based upon the shape of the remediation cell 14. A surface of the water at any given point within the remediation cell 14 may or may not be above a surface of the remediation materials S. In such embodiments, the water level in the remediation cell 14 can be maintained specifically for the benefit of a target plant community. The target plant community, which may require a maximum water depth to thrive, may be well suited to extract water and convert the slurry S, over time, into a soil like material with a lower volume and more desirable properties than the original slurry S. Plants may also be selected to enhance remediation efforts where hydrocarbon or other contaminants may be present, as is commonly the case in stormwater and industrial ponds. Such plants enhance the remediation efforts through natural processes known to those of skill in the art as "bioremediation" or "phytoremediation".

Having reference again to FIG. 4, varying the horizontal spatial deposition of the remediation materials S for each of a plurality of depositions, according to the size and configuration of the remediation cell 14, may be employed. Alternatively, vertical layers of remediation material S may also be deposited. As one of skill in the art would understand, plants or other processes may be generally ineffective at facilitating remediation material S resulting from dewatering through the action of their roots when a layer of remediation material S is too thick. Depending on the target plant community, the degree of semi-isolation of the remediation cell 14 from the recipient pond 10, and the duration available for the target plants to facilitate dewatering of remediation material S, the optimum thickness of materials will vary. By way of example, a typical remediation material thickness may be of the order of 0.5 m if a target plant community were willow bushes and a desired dewatering duration was less than 10 years. One of skill in the art would design a staging process for remediation activities so that horizontal spatial varying of remediation material S deposits or vertical layer deposits could be executed in a manner to achieve optimum remediation results.

Figure 5:
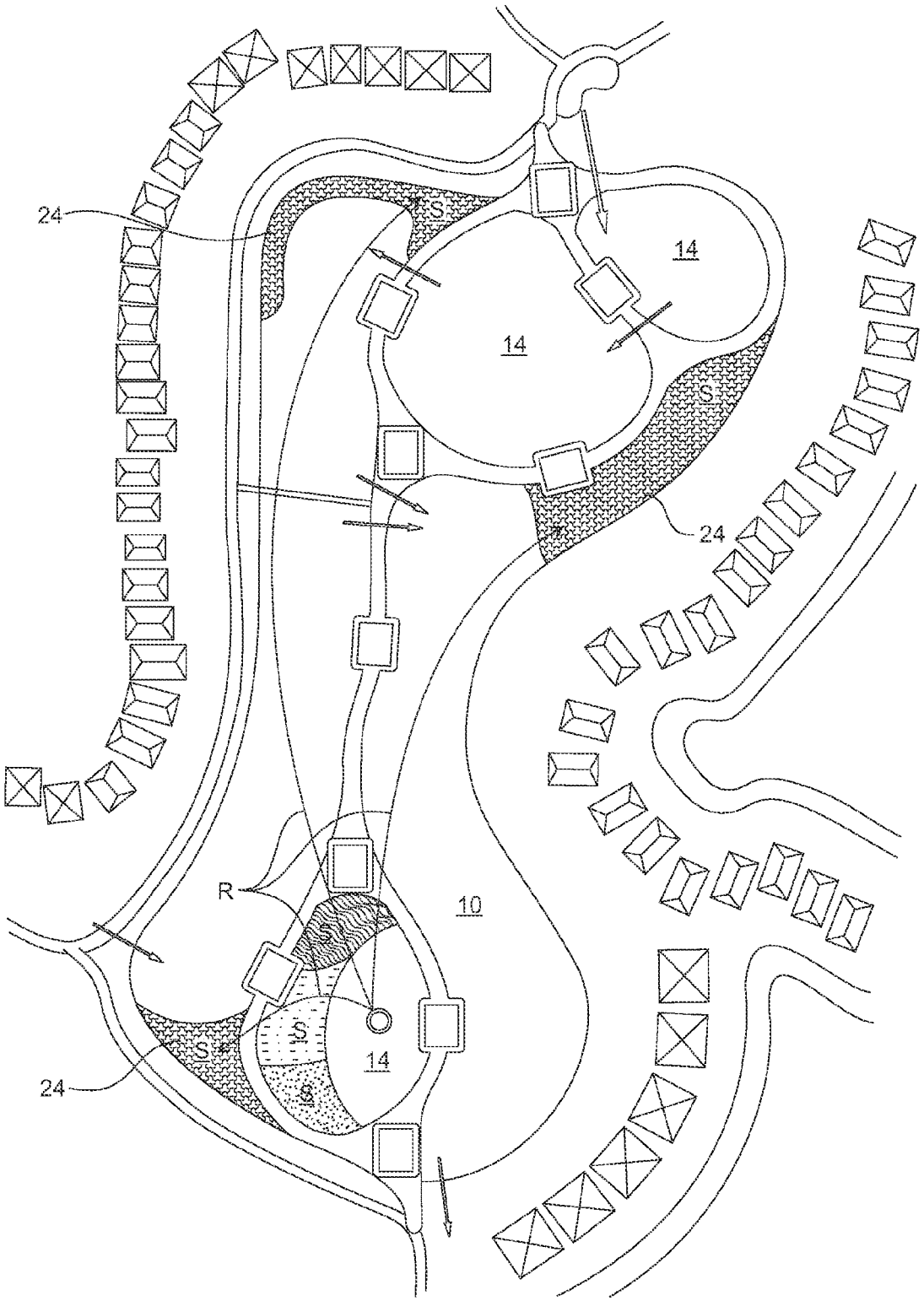
FIG. 5 is a plan view of the stormpond of FIG. 4 illustrating relocation of stored remediation materials from the remediation cell to other areas of the stormpond for creation of wetlands or marshes therein.

In an embodiment, as shown in FIG. 5, thickened material S accumulated over time in the remediation cells 14 is relocated R to other locations within the same or another recipient pond 10 for the creation of wetlands or marshes 24, or other beneficial features therein. Depending on the material properties of the remediation materials S, if pumpable, materials S could be relocated by pumping. If sufficiently thickened, the materials S could be relocated using backhoes or other prior art earth moving equipment well suited to the task.

Upon achieving the desired remediation objective, remediated material S may be removed from the one or more remediation cells 14 for offsite disposal to a location other than a recipient pond 10. The remediated material will generally have been thickened sufficiently that transport is less expensive than would have been the case where remediation materials S contained a larger fraction of water. By way of example, one of skill in the art may deem a desirable threshold for efficient transport to be less than 50% water measured by volume. Alternatively, remediated materials contained in the one or more remediation cells 14 may be deemed a valuable source material for general landscaping projects, farming, composting or other purposes that call for such materials. In such cases, transport costs may be the responsibility of a third party who seeks to use the remediated materials thus further reducing the longterm cost of operating the recipient pond 10 with integrated remediation cells 14.

Figure 6:
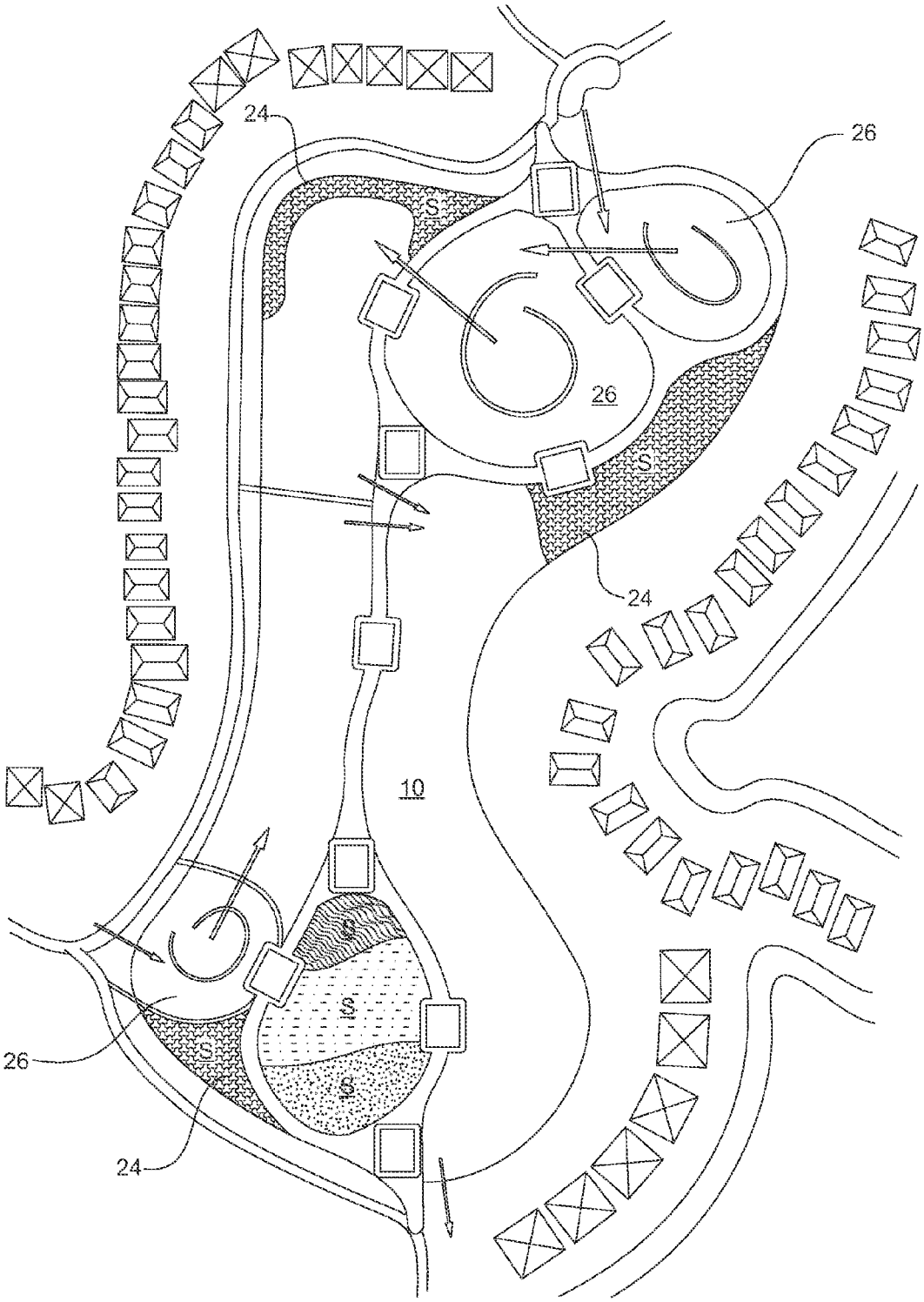
FIG. 6 is a plan view of the stormpond of FIG. 3, at least some of the remediation cells within the pond for receiving inflow thereto being NAUTILUS POND® cells.

There may be a need to remove sediment and the like S from a pond 10 where, for instance, the pond 10 is relatively small compared to a catchment area serviced by the pond 10. In the case of such a small pond 10, there may be very limited available area to reconfigure the pond 10 into a recipient pond 10 having one or more remediation cells 14. In embodiments, therefore, the material S is relocated to an offsite location for disposal or further processing, such as to another pond 10 configured as a recipient pond 10, As shown in FIG. 6, in embodiments, one or more of the remediation cell 14 may be further designed as NAUTILUS POND® cells 26 so as to encourage relocated remediation materials S to be deposited in patterns that favorably influence remediation processes and reduce the cost of future removal of remediation materials S from one or more NAUTILUS POND® cells 26.

In embodiments, and having reference again to FIG. 2, the one or more remediation cells 14 may contain no water between stormwater flood events. In this case, remediation processes occurring in the remediation cells are largely as a result of exposure to the elements and vegetation which establishes therein. The one or more remediation cells 14 are designed such that the energy from flooding of the dry cells 14 does not disrupt the remediation materials S and processes occurring in the cells 14. For example, the remediation cell 14 can be constructed adjacent a portion of a causeway 18 having a slightly lower elevation than a remainder of the causeway 18 so as to preferentially direct initial overflooding of the causeway 18 at this location. The remediation cell 14 is further configured to have a small energy dissipation pool fluidly connected thereto for receiving the initial overflooding for dissipating the energy therein. Water would then be delivered from the dissipation pool to the remediation cell 14 without disruption of the remediation materials S and processes ongoing therein. Applicant believes that there are numerous different strategies which could be employed to initially dissipate the energy of the flood event.

The embodiments in which an exclusive property or privilege is claimed are defined as follows:

1. A system for storage and treatment of remediation materials, the system comprising:

a recipient pond having a pond perimeter; and containment elements positioned within the pond perimeter for forming one or more remediation cells, the one or more remediation cells receiving the remediation materials therein, wherein the one or more remediation cells are positioned away from areas of normal settling of sediment in the recipient pond, and wherein the one or more remediation cells are fluidly connected to the recipient pond for receiving water therein when the water level in the recipient pond is above a normal water level for participating in active storage of water in the pond and at least semi-isolated when the water level is at or near the normal water level for permitting some water exchange with the recipient pond at a rate of influx which minimizes energy imparted thereto for minimizing disruption of remediation processes therein.

2. The system of claim 1 wherein the one or more remediation cells in the recipient pond receive remediation materials from the recipient pond.

3. The system of claim 1 wherein the one or more remediation cells in the recipient pond receive remediation materials from a source other than the recipient pond.

4. The system of claim 1 wherein the containment elements comprise earthen berms, temporary or permanent fabric barriers, rigid wall elements, flexible wall elements, vegetation or combinations thereof.

5. The system of claim 4 wherein the earthen berms are formed from remediation materials recovered from the recipient pond.

6. The system of claim 4 wherein the earthen berms are causeways formed within the recipient pond, the causeways supporting vehicular and pedestrian movement thereon when the pond is at the normal water level.

7. The system of claim 6 further comprising equipment platforms interconnected with the causeways for positioning remediation apparatus thereon.

8. The system of claim 1 wherein the containment elements are not submerged, are partially submerged, are fully submerged or combinations thereof in the recipient pond.

9. The system of claim 8 wherein the containment elements are partially submerged and extend above the normal water level in the recipient pond.

10. The system of claim 9 wherein the containment elements extend about 0.5 m above the normal water level in the recipient pond.

11. The system of claim 1 wherein the containment elements decrease the active water storage in the recipient pond by less than about 10%.

12. The system of claim 1 wherein the one or more remediation cells further comprise a permanent, semi-permanent or portable pump for dewatering the one or more remediation cells for altering material properties of the remediation materials therein.

13. The system of claim 1 wherein the containment elements further comprise vegetation associated therewith.

14. The system of claim 1 wherein the one or more remediation cells further comprise biologically focused systems therein for bioremediation of the remediation materials therein for altering the material properties thereof.

15. The system of claim 14 wherein the biologically focused systems further comprise target plants.

16. The system of claim 15 wherein the one or more remediation cells further comprise a normal level of water therein during normal operation, the water level being designed for growth of the target plants therein.

17. The system of claim 15 wherein the one or more remediation cells are dry in normal operation.

18. The system of claim 1 wherein at least one of the one or more remediation cells has a peripheral inlet and a central discharge therefrom wherein the remediation materials are deposited predominantly about a periphery of the at least one remediation cell.

19. The system of claim 1, wherein the recipient pond is a constructed or natural water body.

20. A method for storage and treatment of remediation materials comprising:

positioning containment elements in a recipient pond for forming one or more remediation cells within a perimeter of the recipient pond, the one or more remediation cells being fluidly connected to the recipient pond for receiving water therein when the water level in the recipient pond is above a normal water level for participating in active storage of water in the pond and at least semi-isolated from the recipient pond when the water level is at or near the normal water level for permitting some water exchange with the recipient pond at a rate of influx which minimizes energy imparted thereto for minimizing disruption of remediation processes therein;

establishing target plants within the one or more remediation cells for forming a biologically focused system therein; and depositing the remediation materials from at least one remediation operation to at least one of the one or more remediation cells in the recipient pond, wherein the biologically focused system enhances bioremediation of the remediation materials therein for altering the material properties thereof.

21. The method of claim 20 further comprising:

maintaining a water depth in the one or more remediation cells for supporting the target plants.

22. The method of claim 21 further comprising:

spatially varying the water depth within the one or more remediation cells in accordance with the shape of the one or more remediation cells for supporting the target plants.

23. The method of claim 20 wherein the one or more remediation cells contain hydrocarbon or other contaminants, further comprising:

selecting the target plants for bioremediation of the hydrocarbon or other contaminants.

24. The method of claim 20 further comprising:

maintaining an optimum thickness of vertical layers of remediation materials deposited in the one or more remediation cells for facilitating dewatering of the remediation materials by the target plants over a selected period of time.

25. A system for storage and treatment of remediation materials, the system comprising:

a recipient pond having a pond perimeter;

containment elements positioned within the pond perimeter for forming one or more remediation cells, the one or more remediation cells receiving the remediation materials therein; and biologically focused systems in the one or more remediation cells for bioremediation of the remediation materials therein for altering the material properties thereof, the biologically focused systems further comprising target plants, wherein the one or more remediation cells are fluidly connected to the recipient pond for receiving water therein when the water level in the recipient pond is above a normal water level for participating in active storage of water in the pond and at least semi-isolated when the water level is at or near the normal water level for permitting some water exchange with the recipient pond at a rate of influx which minimizes energy imparted thereto for minimizing disruption of remediation processes therein.

26. The system of claim 25 wherein the one or more remediation cells further comprise a normal level of water therein during normal operation, the water level being designed for growth of the target plants therein.

27. The system of claim 25 wherein the one or more remediation cells are dry in normal operation.

28. The system of claim 25 wherein at least one of the one or more remediation cells has a peripheral inlet and a central discharge therefrom wherein the remediation materials are deposited predominantly about a periphery of the at least one remediation cell.

29. The system of claim 25 wherein the one or more remediation cells in the recipient pond receive remediation materials from the recipient pond.

30. The system of claim 25 wherein the one or more remediation cells in the recipient pond receive remediation materials from a source other than the recipient pond.

31. The system of claim 25 wherein the containment elements comprise earthen berms, temporary or permanent fabric barriers, rigid wall elements, flexible wall elements, vegetation or combinations thereof.

32. The system of claim 31 wherein the earthen berms are formed from remediation materials recovered from the recipient pond.

33. The system of claim 31 wherein the earthen berms are causeways formed within the recipient pond, the causeways supporting vehicular and pedestrian movement thereon when the pond is at the normal water level.

34. The system of claim 33 further comprising equipment platforms interconnected with the causeways for positioning remediation apparatus thereon.

35. The system of claim 25 wherein the containment elements are not submerged, are partially submerged, are fully submerged or combinations thereof in the recipient pond.

36. The system of claim 35 wherein the containment elements are partially submerged and extend above the normal water level in the recipient pond.

37. The system of claim 36 wherein the containment elements extend about 0.5 m above the normal water level in the recipient pond.

38. The system of claim 25 wherein the containment elements decrease the active water storage in the recipient pond by less than about 10%.

39. The system of claim 25 wherein the one or more remediation cells further comprise a permanent, semi-permanent or portable pump for dewatering the one or more remediation cells for altering material properties of the remediation materials therein.

40. The system of claim 25 wherein the containment elements further comprise vegetation associated therewith.

41. The system of claim 25 wherein the recipient pond is a constructed or natural water body.

* * * * *